United States Patent [19]

Müller

[11] Patent Number: 5,068,980

[45] Date of Patent: Dec. 3, 1991

[54] POCKET SEALING STRIP ARRANGEMENT IN A SINGLE-WIRE DRYING GROUP

[75] Inventor: Wolfgang Müller, Giengen, Fed. Rep. of Germany

[73] Assignee: J. M. Voith GmbH, Fed. Rep. of Germany

[21] Appl. No.: 534,119

[22] Filed: Jun. 6, 1990

[30] Foreign Application Priority Data

Mar. 16, 1990 [DE] Fed. Rep. of Germany ..... 4008434

[51] Int. Cl.[5] ..... F26B 11/02

[52] U.S. Cl. ..... 34/117; 34/116; 34/120

[58] Field of Search ..... 34/115, 116, 117, 122, 34/123, 15, 16, 23, 120, 158

[56] References Cited

U.S. PATENT DOCUMENTS

| | | | |
|---|---|---|---|
| 3,461,569 | 9/1969 | Kottick | 34/116 |
| 4,441,263 | 4/1984 | Vedenpaa | 34/115 |
| 4,876,803 | 10/1989 | Wedel | 34/116 |
| 4,905,379 | 3/1990 | Wedel | 34/115 |

*Primary Examiner*—James C. Yeung

*Attorney, Agent, or Firm*—Ostrolenk, Faber, Gerb & Soffen

[57] ABSTRACT

A paper web travels together with a support belt over two heatable drying cylinders and a guide roll between the cylinders, which together define a pocket. Vacuum prevails in the pocket upon operation. Above the pocket there is provided a sealing strip support with sealing strips fastened to it. The sealing strips are at the drying cylinders where they enter the pocket, and these strips counter the penetration of air into the pocket. The sealing strip support is moveable in various ways so that the distance between the sealing strips and the cylinder outer surfaces can be enlarged temporarily. The guide roll is hollow, is connectable with a vacuum source and has a perforated roll shell and is free of stationary inserted parts. A separate vacuum source communicates with extra perforations at axial end edge chambers of the guide roll for applying greater vacuum at the edge chambers than over the remainder of the roll.

27 Claims, 4 Drawing Sheets

E
I
I
45
52
50
51
49
48
48
47
46
33
33
31
13
30
26'
25A
37
37
39
39
38
38
40
40
41
41
42
42
43
43
44
44
34
34'
35
36
10
25
25'
24
26
26'
15
16
14
21
21'
17
17'
18
18'
19
19'
20
23
23'
27
7
8'

POCKET SEALING STRIP ARRANGEMENT IN A SINGLE-WIRE DRYING GROUP

BACKGROUND OF THE INVENTION

The present invention relates to an arrangement in a single-wire drying group having two drying cylinders in succession and a guide roll between them. In this arrangement, there is a first drying cylinder followed by a second drying cylinder and a guide roll between them. The guide roll is positioned off a central plane, which is defined by the axes of the two drying cylinders. A pocket is defined between the central plane, the drying cylinder and the guide roll. A sealing strip support is disposed outside the pocket, and it supports at least a first sealing strip which is placed at the first drying cylinder for stripping away the air entering the pocket on a belt, as explained below, entering the pocket over the first cylinder. Possibly, a second sealing strip is supported at the second drying cylinder, as well. The web passes from the first drying cylinder to the guide roll to the second drying cylinder of the group.

Typically a porous support belt or wire, and preferably a single wire, supports the web and transfers the web from the first cylinder, to the guide roll and to the second cylinder. The web is placed on that side of the belt as to have the web contact the drying cylinders directly and be separated from the guide roll by the porous belt. Such an arrangement is preferably part of a paper manufacturing machine and is known from U.S. Pat. No. 4,876,803.

In a single-wire drying group, the web to be dried, preferably a paper web, is conducted continuously by the porous support belt and pressed against the drying cylinders. The web and support belt travel, for instance, from a first drying cylinder jointly over as short a path as possible to the following first guide roll and from the first guide roll back to a second drying cylinder and then via a second guide roll to a third drying cylinder, and so on.

The guide rolls can be arranged symmetrically at equal distances from the two adjacent drying cylinders. However, an asymmetric arrangement has also been proposed in which the smallest possible distance is present between the first drying cylinder and the first guide roll, and a substantially greater distance between the first guide roll and the second drying cylinder. It is essential that upon leaving the first drying cylinder, the web does not remain adhering to that cylinder but instead is drawn on the support belt by the production of a vacuum in the pocket. In the same way, the web must be drawn against the support belt against the centrifugal force acting on it in the wrapping zone of the guide roll. Finally, the web must also be held reliably against the support belt in the free path of travel between the guide roll and the second drying cylinder. In this way, the danger of folds forming in the web upon the entrance onto the second drying cylinder is prevented. A few older known proposals for the solutions of these problems are described in the following publications, U.S. Pat. No. 3,868,780; International Application WO 83/00514; U.S. Pat. No. 4,876,803, FIGS. 4 to 10.

FIGS. 14 to 17 of U.S. Pat. No. 4,876,803, show arrangements in which the guide roll, having a perforated roll shell, is free of stationary inserts. The production of a vacuum in the pocket and on the periphery of the guide roll is effected by drawing air out of the inside of the guide roll through at least one of the two hollow roll journals and by providing a sealing strip in the center plane of the cylinders, which plane is determined by the axes of the two drying cylinders. The sealing strip is fastened in accordance with FIG. 12 of that patent to a sealing strip support which extends transversely through the drying group through the pocket and the cross section of which is adapted to the shape of the pocket.

Problems arise with this known construction of the sealing strip and of the sealing strip support:

1. The possibility can never be certainly excluded that the web to be dried will not tear at some point in the dryer group. The reject paper resulting therefrom may in many cases drop downward and thus be removed from the machine without difficulty. In other cases, however, there is the danger that the reject paper will wind up on a drying cylinder. At times, pieces of reject paper also pass into the pocket and/or into the region between the support belt and the guide roll. In such cases, there is a danger that the support belt will be damaged and/or that the removal of the reject of the break will be prevented by the sealing strip support.

2. Even in the case of undisturbed operation of the paper machine, the endless support belt has only a limited life. It must therefore be replaced by a new belt from time to time. During the introduction of the new support belt, the belt is not yet an endless one. A lath or bar is fastened to one end of the support belt and by means of the lath or bar, the support belt is then pulled over the drying cylinders and over the guide rolls into the machine. The bar or lath is then removed from the support belt and the two ends of the belt are connected together in order to remake the support belt endless. During the introduction of the drier wire, therefore, a sufficient distance must be present between the cylinder outer surfaces and the said sealing strips and sealing strip supports. In case of the construction in accordance with U.S. Pat. No. 4,876,803, the seals, and possibly also the seal supports, must be removed, which is extremely time-consuming and costly.

3. Due to the vacuum prevailing in the pocket, the travel path of the support belt together with the paper web between the cylinders and the guide roll is not linear but is curved somewhat inwards. In this way, there is a danger that the support belt will rub against the sealing strip support and therefore become prematurely worn.

SUMMARY OF THE INVENTION

The primary object of the present invention is to improve the above arrangement and to further simplify it such that, on the one hand, the removal of reject paper and, on the other hand, the introduction of a new support belt can be effected easier and faster than heretofore.

The web to be dried travels along with a porous support belt, for instance in the form of a drying wire, over a first heatable drying cylinders and then over a guide roll and then over a second heatable drying cylinder. The drying cylinder and guide rolls rotate as the support belt and web move along. Each of the guide rolls preferably has a perforated rotatable shell and is free of stationary insertion parts. The two drying cylinders have axes which together define a central plane. The guide roll is off the central plane and completes a pocket between the drying cylinders. It is necessary that a reduced pressure, a somewhat vacuum condition, prevail in the pocket. For accomplishing this purpose, for example, the interior of the guide roll may be connected to a vacuum source. Additionally, there is a sealing strip fastened to a sealing strip support that is in the vicinity of at least the first drying cylinder where the web is entering the pocket and possibly also in the vicinity of the second drying cylinder where the web is leaving the pocket. The sealing strips block the penetration of air into the pocket and thereby somewhat assist the generation of a vacuum condition in the pocket. Preferably, the sealing strip support is itself arranged at least predominantly outside the pocket. That would be above the central plane between the axes of the drying cylinders. Preferably also, the distance between the sealing strip and the support belt is variable or adjustable, particularly its distance from the first of the drying cylinders, and perhaps the distance of another sealing strip from the second of the drying cylinders is also variable. For this purpose, the sealing strip support itself may be shiftable transversely to the central cylinder plane.

According to the invention, the sealing strip support is no longer arranged in the pocket, and therefore is not between the cylinder central plane and the guide roll. It is instead at least predominantly on the other side of the cylinder central plane, and therefore at least predominantly outside of the pocket. Furthermore, the sealing strip, which in normal operation extends at the first drying cylinder at a very small distance from the support belt, for instance, 1 mm, transverse to the direction of travel of the support belt, should be adapted to be removed when necessary from the support belt. This can be done in various ways, for instance, in the manner that the sealing strip alone is arranged swingably or in the manner that the entire sealing strip support together with the sealing strip is made moveable, particularly transversely to the central cylinder plane.

In all cases, the invention has the advantage that the pocket, and therefore the region between the cylinder central plane and the guide roll, is entirely or at least predominantly free of installed parts. In this way, the pocket is easily accessible for the removal of any reject paper which has possibly entered the pocket. Furthermore, the danger of the support belt becoming prematurely worn by possible sliding on the sealing strip support is eliminated.

In addition, by the arrangement of the sealing strip support outside the pocket, there is sufficient freedom to be able to dimension the cross section of the sealing strip support sufficiently large, and to thus obtain the greatest possible stiffness of the sealing strip support. It is now no longer necessary to arrange the walls of the sealing strip support at a very small distance from the cylinder outer surfaces in order to obtain the necessary stiffness as had been the case up to now. In this connection, the length of the sealing strip support can amount to about 10 m, corresponding to the width of modern paper making machines. Furthermore, the smallest possible distance is desirable between the two adjacent drying cylinders and, furthermore, the smallest possible distance between the first drying cylinder and the guide roll, and possibly also between the guide roll and the second drying cylinder are desirable. Thus, the cross section of the pocket is very small as compared with the cross section of the sealing strip support which is frequently necessary.

The invention can be used together with different methods of producing vacuum in the pocket and in the guide roll. For example, the sealing strip support can be developed as a suction box so that a vacuum is first produced in the pocket which is propagated into the inside of the guide roll and from there to the outer circumference of the guide roll.

However, it is better to produce the vacuum primarily within the guide roll by connecting a source of vacuum to one of the two roll journals which is developed hollow for this purpose. It is favorable to keep the other of the two roll journals free of a suction connection. Thus, a coaxially arranged drive device can be connected there directly to the guide roll. An expensive gearing arrangement, as might be needed to drive a hollow journal, is unnecessary. However, if a drive for the guide roll can be dispensed with, it is also possible to make both roll journals hollow and connect them to a source of vacuum.

Preferably, at least one end region and more preferably, both end regions of the guide roll are provided with means which increase the vacuum at these edge regions as compared with the vacuum inside the remainder of the roll. For example, additional perforations are provided in the edge regions and/or a separate vacuum source communicates with these edge regions for this purpose.

Other features and advantages of the present invention will become apparent from the following description of the invention which refers to the accompanying drawings.

BRIEF DESCRIPTION OF THE DRAWINGS

Further developments of the invention are described below with reference to embodiments shown in the drawing, in which.

DETAILED DESCRIPTION OF THE DRAWINGS

Figure 1A:
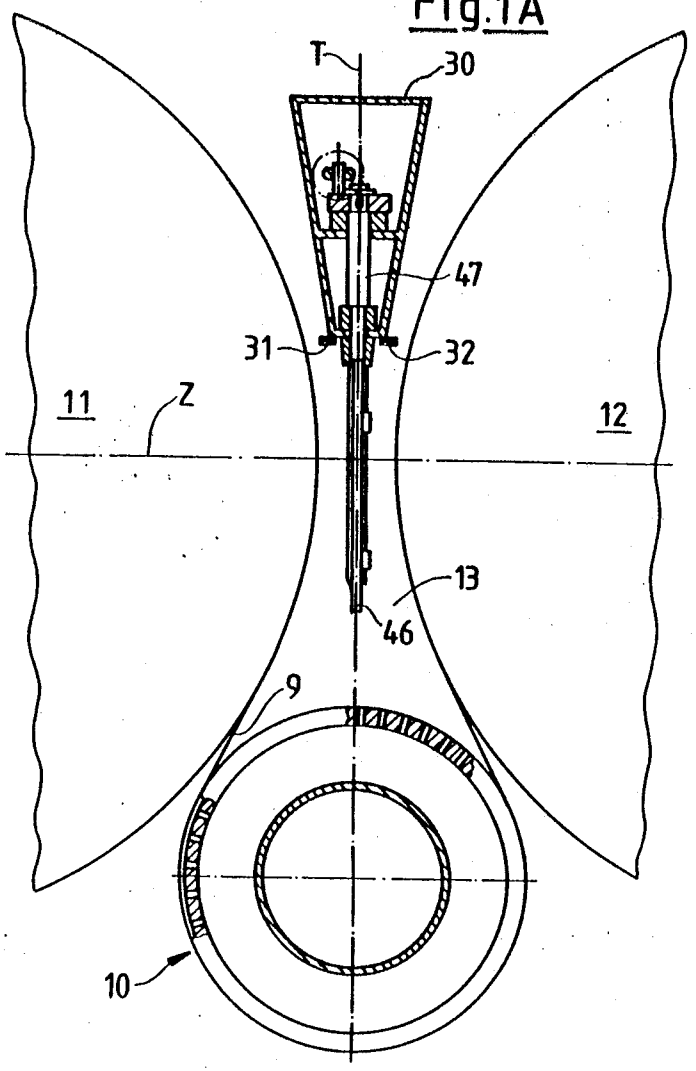
FIG. 1A shows the same arrangement as FIG. 1, but with the sealing strip support moved outward.
Figure 1:
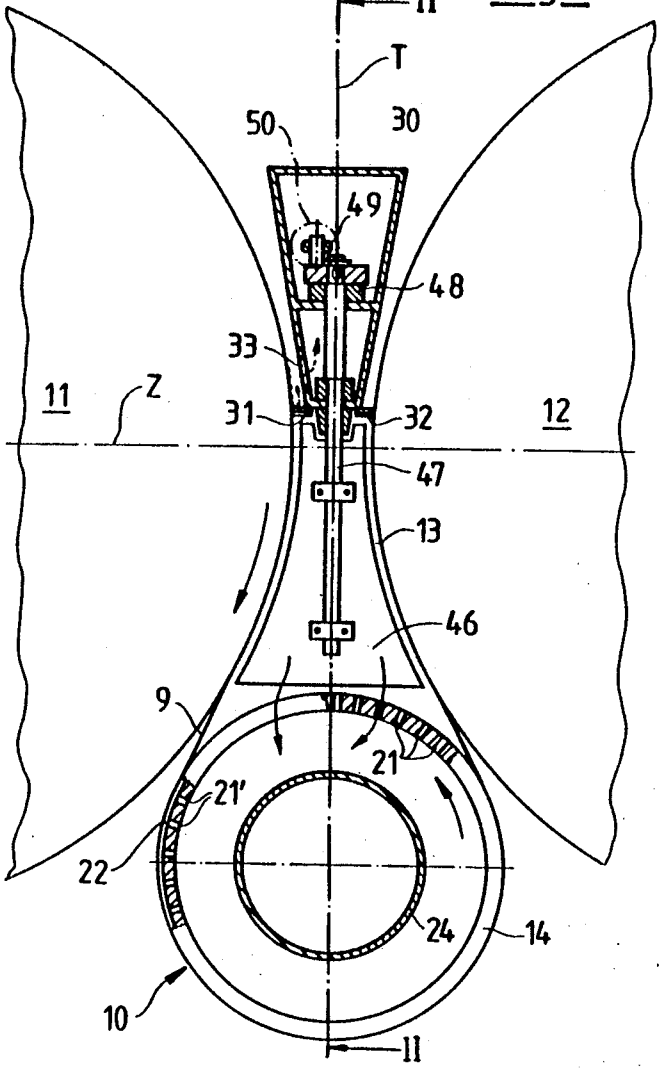
FIG. 1 shows an arrangement in a single wire drying group with sealing strip support shown in cross section, seen in operating position and on a section along the line I—I of FIG. 2.

In FIG. 1 there can be noted two drying cylinders 11 and 12 arranged one after the other along the path of the web, a guide roll 10 located between the cylinders 11 and 12, and a support belt 9 which travels together with the web of paper to be dried from the first drying cylinder 11 to the guide roll 10 and from the latter to the second drying cylinder 12. The space present between the cylinders 11 and 12 is referred to as "pocket" 13. In accordance with the definitions of the present patent application, this pocket 13 is limited toward the outside by a so-called cylinder central plane Z which is determined by the axes of the two drying cylinders. In the embodiment shown, this cylinder central plane Z is horizontal. The guide roll 10 lies below this cylinder central plane. The invention, however, can also be used with many other arrangements. For example, the guide roll 10 can lie above the horizontal cylinder central plane Z. It is also possible to arrange the drying cylinders at least approximately vertically one above the other so that the guide roll is located to the right or left of the drying cylinders.

Figure 2:
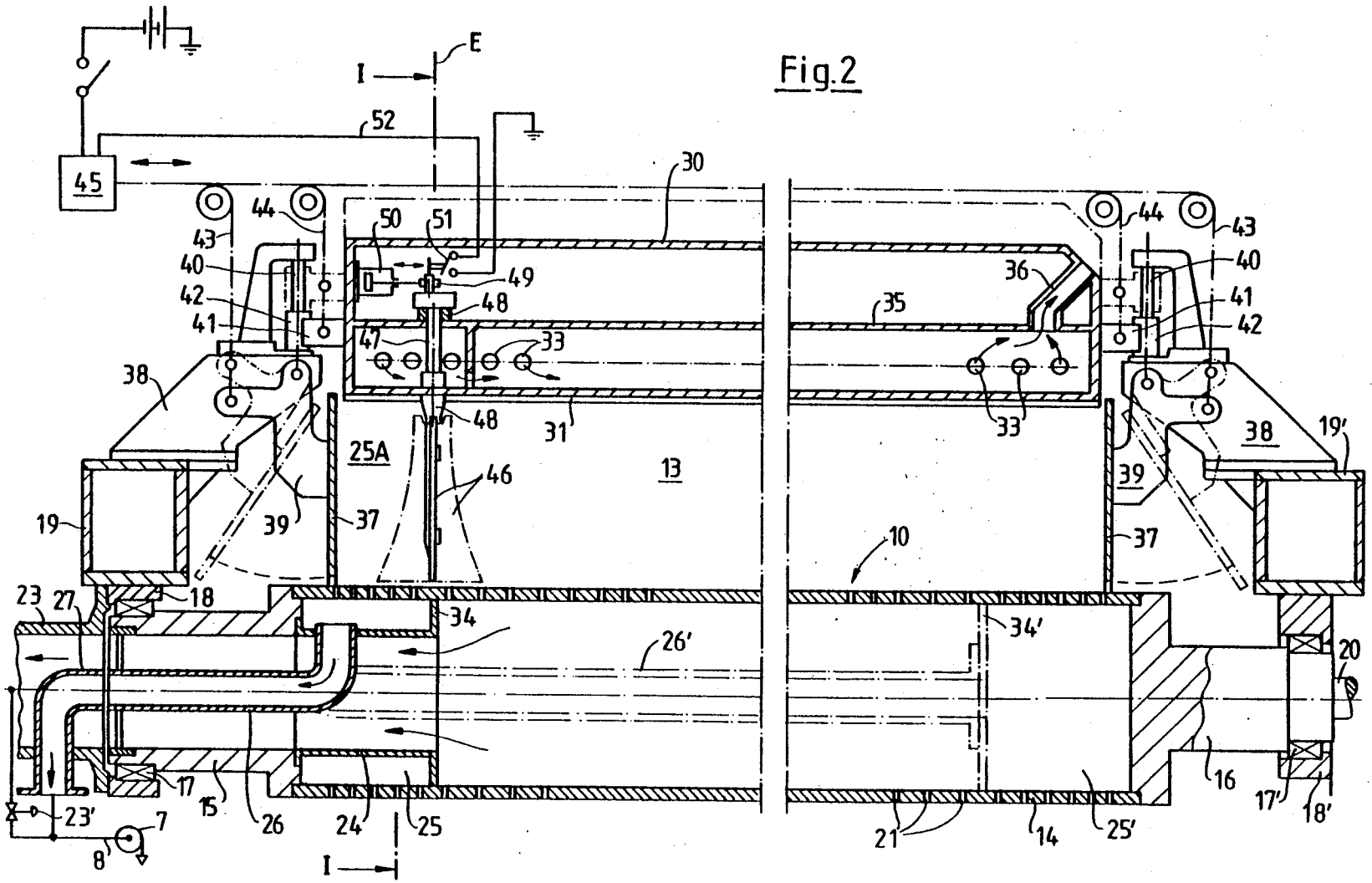
FIG. 2 is a longitudinal section through a sealing strip support and guide roll viewed along the line of and in the direction II—II of FIG. 1.

In FIGS. 1 and 2, the guide roll 10 has a perforated roll shell 14. Within the shell 14, a hollow journal 15 is inserted into one end of the roll (the left end in FIG. 2), while a solid journal 16 is inserted into the other end of the roll. The entire turnable roll body 14 to 16 rests, via anti-friction bearings 17, 17', in bearing brackets 18, 18' which are fastened in customary manner to longitudinal girders or beams 19, 19'. If the guide roll 10 is to be provided with a rotary drive, a drive journal 20 can be developed on the solid journal 16. The roll shell 14 is preferably provided with simple bore holes 21 passing through it. As an alternative to this, circumferential grooves 22 can be provided in the outer surface of the roll shell 14 into which the holes 21' debouch, as shown in FIG. 1.

In order to produce within the guide roll 10 a vacuum which propagates itself into the pocket 13, a vacuum conduit 23 is screwed to the bearing bracket 18. FIG. 2 symbolically shows that the vacuum conduit is connected via a valve 23' to the suction line 8 of a blower 7.

At the so-called either lead strip roll end or tail threading roll end (the left roll end in FIG. 2) an edge chamber 25 is formed within the inside of the roll (by means of a tubular insert 24 provided with a flange 34). A suction pipe 26 is connected to this chamber and the pipe rotates with the roll body and extends outward through the hollow roll journal 15. As a continuation of the suction pipe 26, a stationary connecting line 27 is provided within the vacuum conduit 23. The line 27 is connected directly to the suction line 8 of the blower 7. Thus, when the "tail" or lead strip of the web is threaded into the drying group, a vacuum can be produced in the chamber 25 alone by closing the valve 23'. Upon normal operation, i.e. with the valve 23' open, approximately the same vacuum preferably prevails in the edge chamber 25 as in the rest of the inside of the guide roll 10. As an alternative possible modification, the edge chamber 25 is connected, via the conduits 26 and 27, not to the line 8, but to a separate source of vacuum (not shown) which produces a higher vacuum than the blower 7. In this case, as shown by the dash-dot lines, one can also form on the opposite end of the roll by means of an intermediate wall 34', an edge chamber 25' which is connected via a central connecting line 26' to the suction pipe 26. In normal operation, one can draw the edges of the web of paper more strongly against the support belt than the central region of the web of paper is drawn against the belt.

In order to maintain a certain vacuum in the pocket 13, the flow of air into the pocket must be prevented as far as possible. Therefore, outside the pocket is a sealing strip support 30, which is developed as a hollow body which extends parallel to the guide roll and extends transversely through the entire dryer group. For example, two sealing strips 31, 32 are fastened to the bottom of the support 30 and therefore are approximately in the cylinder central plane Z, or somewhat above it, as shown in FIG. 1. The sealing strips 31, 32 are formed of a resilient material which is as soft as possible, for instance of felt. Both sealing strips can lightly contact the support belt 9. However, a small distance (on the order of magnitude of 1 to 2 mm) can also be maintained between the support belt and each of the sealing strips.

As is known, the support belt 9, which extends over the first drying cylinder 11, carries an air boundary layer along with it on its exterior. This layer is stripped off, as far as possible, from the support belt by the one sealing strip 31 and is deflected in the opposite direction. It may be advisable to provide suction openings 33 in the sealing strip support 30 in order to draw off the deflected boundary layer of air. For this purpose, a partition wall 35 having a suction connection line 36 can be provided in the sealing strip support. Or else, the sealing strip support is made "air pervious", i.e. openings are provided not only near the sealing strip but also in the opposite wall of the sealing strip support.

While the sealing strip 31 present on the side of the first drying cylinder is indispensable, the other sealing strip 32 may possibly be omitted, as will be explained further below.

In order that the penetration of air into the pocket is prevented or impeded also on the two ends of the pocket (and therefore in the region of the two roll ends of the guide roll 10), end walls 37 are provided. Their shape is adapted, as far as possible, to the cross-sectional shape of the pocket.

FIG. 2 shows, diagrammatically, how the sealing strip support 30 and the end walls 37 can be movably suspended. For this purpose, a pedestal 38 is provided on each of the longitudinal beams 19, 19' and a swing lever 39, which bears the end wall 37, is rotatably mounted on the pedestal. Furthermore, on each of the pedestals 38 there is provided a guide rod 40 which in the present case is vertical and on which a support arm 41 of the sealing strip support 30 can slide by means of a guide hub 42. Cables 43, 44 are attached to the swing levers 39 and the support arms 41. When they are pulled by a common lift device 45, the sealing strip support 30 is lifted and the end walls 37 swing out laterally, as indicated by dash-dot lines, simultaneously. Obviously, instead of the cable lift device 43 to 45, other actuating means can also be used, for instance hydraulic cylinders.

From the bottom of the sealing strip support 30 a partition wall 46 is suspended so that an edge chamber 25A corresponding to the edge chamber 25 of the guide roll 10 is formed also in the pocket 13. The shape of the intermediate wall is adapted to the outer surfaces of the drying cylinders 11, 12. The partition wall 46 is fastened on a rotary shaft 47 which is mounted at bearing 48 in the sealing strip support 30. The rotary shaft 47 is connected via a swing drive 49 to a pneumatic cylinder 50. In this way, the partition can be turned 90° back and forth. In the normal position of the partition 46 it extends in an intermediate plane E, perpendicular to the axis of rotation of the guide roll. The flange 34 of the tubular insert 24 also at least approximately lies in the plane E. When the partition 46 is turned by 90°, it lies in a pocket central plane T located between the two drying cylinders 11, 12. This position is shown in FIG. 1A and furthermore in dash-dot lines in FIG. 2.

As can be seen, the partition 46 must be turned into the position shown in FIG. 1A before the sealing strip support 30 is moved upward. Therefore, an interlock device is provided which blocks the lifting device 44, 45 of the sealing strip support 30 as long as the partition 46 lies in the intermediate plane E. The interlock device can, for instance, be provided on the swing device 49. It comprises a limit switch 51 which is connected via a line 52 to the lift device 45.

FIG. 1A shows the sealing strip support 30 in the upward extended position and with the partition 46 turned 90° and therefore lying in the pocket central plane T. In this position, sufficient distance is present between the sealing strips 31 and 32 and the support belt 9.

Figure 3:
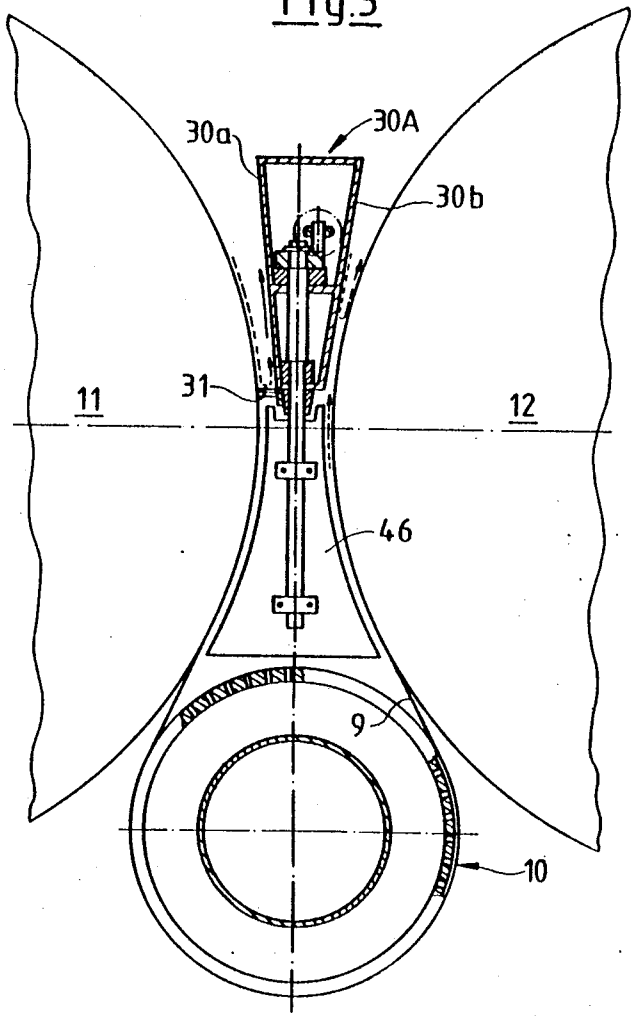
FIG. 3 shows a modification of the arrangement of FIG. 1.

In FIG. 3, the sealing strip support 30A differs from that in FIG. 1, as it has an asymmetrical cross-sectional shape. This asymmetry is produced in that the side wall 30*a* facing the first drying cylinder 11 is at a greater distance from the drying cylinder 11 than the other side wall 30*b* is from the second drying cylinder 12. This provides more room for the return of the boundary layer of air that has been deflected on the sealing strip 31. In this way, one can possibly dispense with a drawing-off of the boundary layer of air. Furthermore, in FIG. 3 the sealing strip (32 in FIG. 1) facing the second cylinder 12 is omitted. This is based on the assumption that the support belt 9 traveling upward over the second drying cylinder 12 exerts, in the space between the sealing strip support 30 and the cylinder 12, a sufficient braking action on the air which attempts to enter the pocket 13 due to the vacuum prevailing in the pocket.

Figure 4:
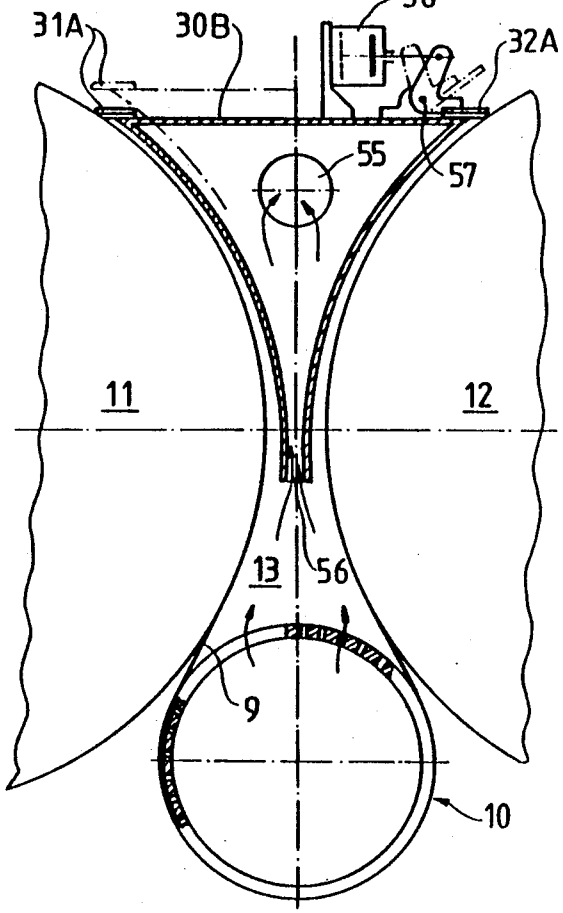

FIG. 4 shows a variant sealing strip support 30B which is developed as a suction box and which has a suction connection 55 and a suction opening 56 which debouches into the pocket 13. Another difference from FIG. 1 is that the sealing strips 31A and 32A are arranged at the top of the sealing strip support. Thus, a smaller path of displacement (as compared with FIGS. 1 and 1A) for the upward movement of the sealing strip support is sufficient to remove the sealing strips from the vicinity of the belts. As a further variant, in the example of the sealing strip 32A, that sealing strip can rest in a swivel bearing 57 and be adapted to be lifted from the drying cylinder 12, for instance, by means of a pneumatic cylinder 58. In this case the upward motion of the sealing strip support can be avoided.

Figure 5:
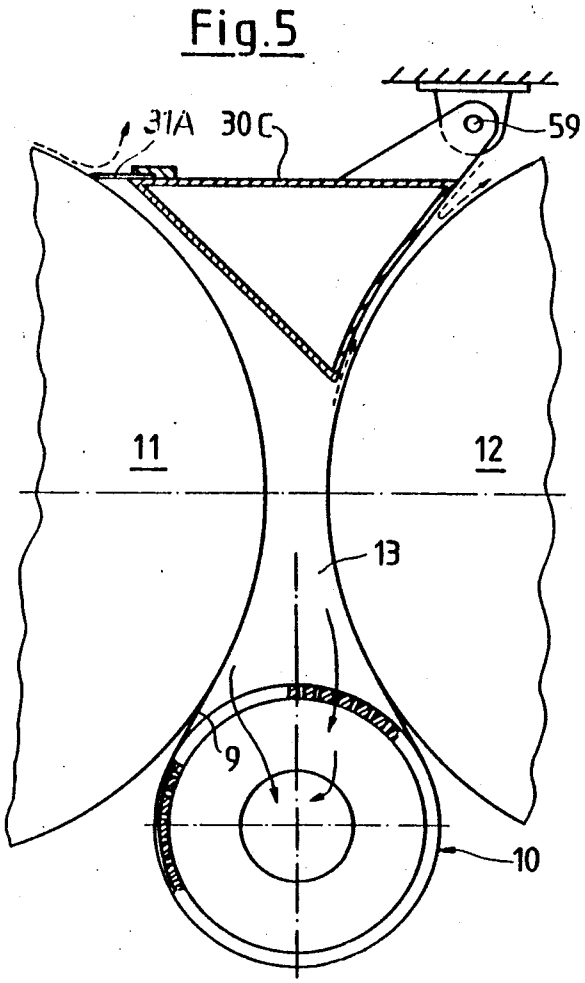
FIGS. 4 and 5 show other embodiments of the invention, in each case in a cross section through the sealing strip support.

In yet another embodiment, shown in FIG. 5, the sealing strip support 30C is swingable upward around a rotary shaft 59 which lies outside the pocket and at a slight distance from the outer surface of the second drying cylinder 12. This variant is usable in the event that only the sealing strip 31A facing the first drying cylinder 11 is present.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An arrangement for a single-wire drying group for a web of paper, or the like, to be dried, the drying group comprising:

a first drying cylinder having an outer surface and located upstream in the path of travel of a flexible porous support belt, a second drying cylinder having an outer surface and located downstream of the first drying cylinder in the path of travel of the support belt, and a guide roll having an outer surface and disposed between the first and second cylinders along the path of travel of the support belt, such that the support belt travels from the first drying cylinder to the guide roll and then to the second drying cylinder;

the first and second drying cylinders and the guide roll being so placed with respect to each other that they together define a pocket between the first and second cylinders;

a sealing strip in the vicinity of the outer surface of the first drying cylinder, means supporting the sealing strip at a location for blocking the penetration of air into the pocket along with the entrance into the pocket of the support belt;

said pocket having reduced pressure because of said sealing strip blocking the penetration of air into the pocket and generating a partial vacuum condition in said pocket;

a variable spacing being defined between the sealing strip and the support belt that is passing over the first drying cylinder, said spacing being variable due to the sealing strip support itself being shiftable transversely to a central cylinder plane; the sealing strip support being located at least predominantly outside the pocket at the side of the central plane away from the guide roll;

the first and second cylinders having respective rotation axes that define said central plane between the rotation axes of the drying cylinders, the guide roll being at one side of the central plane, the pocket being defined between the drying cylinders and the guide roll and being defined at the side of the central plane toward the guide roll;

a porous support belt for passing from the first drying cylinder, then over the guide roll, and then over the second drying cylinder; the drying cylinders, the guide roll and the porous support belt being so placed with respect to each other and being so arranged with respect to a web to be dried that such web is present between the outer surfaces of the first and second cylinders and the support belt, and such that the support belt is present between the guide roll outer surface and the web.

2. The arrangement of claim 1, wherein the guide roll has a perforated rotatable roll shell.

3. The arrangement of claim 2, further comprising a hollow roll journal on which the guide roll is supported, the roll journal being open toward the inside of the guide roll, the hollow roll journal being connectable with a vacuum source, whereby vacuum applied to the hollow roll journal will create suction at the perforations of the shell of the guide roll for inducing reduced pressure in the pocket.

4. The arrangement of claim 3, wherein the guide roll has axial end regions, at least one of the end regions defining an edge chamber toward the respective end of the guide roll, and the perforations in the guide roll shell being adapted such that a higher vacuum may be established in the edge region than in the rest of the inside of the roll.

5. The arrangement of claim 4, further comprising a suction pipe within the hollow guide roll for connecting the first edge chamber with a vacuum source.

6. The arrangement of claim 5, wherein the hollow roll journal is a rotatable journal the suction pipe is fastened to the rotatable roll journal, the suction pipe having an outer end section which is non-rotatable with respect to the part of the suction pipe fastened to the roll journal, and a stationary structural part receiving and holding the outer end section of the suction pipe.

7. The arrangement of claim 4, further comprising a vacuum source connected with the edge chamber, the remainder of the inside of the roll is connected with the vacuum source, and a flow limiting valve between the vacuum source and the remainder of the inside of the wall.

8. The arrangement of claim 7, further comprising a second edge chamber of the guide roll at the opposite end of the guide roll from the first edge chamber; a conduit from the second edge chamber to the suction pipe inside the guide roll for connecting vacuum to the second edge chamber.

9. The arrangement of claim 4, wherein the guide roll has an opposite end, opposite the end of which the first edge chamber is defined; a drive pin on the opposite end of the roll for connection to a coaxially arranged drive device.

10. The arrangement of claim 2, wherein the guide roll includes a hollow roll journal at an end thereof, and the journal opens toward the inside of the guide roll, and the hollow roll journal being connectable with a vacuum source;

a first edge chamber at a first end region of the guide roll, and means for generating a higher vacuum in the first edge chamber than in the rest of the interior of the guide roll.

11. The arrangement of claim 1, wherein the drying cylinders are heatable drying cylinders.

12. The arrangement of claim 1, wherein the sealing strip support is displaceable transversely to the central plane.

13. The arrangement of claim 12, wherein the distance between the drying cylinders is smaller than the diameter of the guide roll and the sealing strip can be placed relatively near to the central plane for reducing the volume of the pocket, and the sealing strip being movable transversely of the central plane and out of the pocket.

14. The arrangement of claim 1, further comprising swivel bearings on the sealing strip support and to which the sealing strip is connected, such that the sealing strip may swivel toward and away from the respective drying cylinder.

15. The arrangement of claim 1, wherein there is a respective sealing strip at each of the first and second drying cylinders and the sealing strip support supports both of the sealing strips.

16. The arrangement of claim 1, further comprising a rotary shaft outside the pocket and spaced from the outer surface of the second drying cylinder, and the sealing strip support being rotatable on the rotary shaft for moving the sealing strip toward and away from the first drying cylinder.

17. The arrangement of claim 3, wherein the sealing strip support has a hollow interior with an entrance opening toward the pocket between the drying cylinders and the guide roll, and the hollow sealing strip support being connectable with a vacuum source for inducing reduced pressure in the pocket.

18. The arrangement of claim 1 wherein:

the drying cylinders are heatable drying cylinders;

the guide roll has a perforated rotatable roll shell;

a hollow roll journal on which the guide roll is supported, the roll journal being open toward the inside of the guide roll, the hollow roll journal being connectable with a vacuum source, whereby vacuum applied to the hollow roll journal will create suction at the perforations of the shell of the guide roll for inducing reduced pressure in the pocket;

the guide roll has axial end regions, at least one of the end regions defining an edge chamber toward the respective end of the guide roll;

a suction pipe within the hollow guide roll for connecting the first edge chamber with a vacuum source;

the hollow roll journal is a rotatable journal the suction pipe is fastened to the rotatable roll journal, the suction pipe having an outer end section which is nonrotatable with respect to the part of the suction pipe fastened to the roll journal, and a stationary structural part receiving and holding the outer end section of the suction pipe.

19. An arrangement for a single-wire drying group for a web of paper, or the like, to be dried, the drying group comprising:

a first drying cylinder having an outer surface and located upstream in the path of travel of a flexible porous support belt, a second drying cylinder having an outer surface and located downstream of the first drying cylinder in the path of travel of the support belt, and a guide roll having an outer surface and disposed between the first and second cylinders along the path of travel of the support belt, such that the support belt travels from the first drying cylinder to the guide roll and then to the second drying cylinder;

the first and second drying cylinders and the guide roll being so placed with respect to each other that they together define a pocket between the first and second cylinders;

a sealing strip in the vicinity of the outer surface of the first drying cylinder, means supporting the sealing strip at a location for blocking the penetration of air into the pocket along with the entrance into the pocket of the support belt;

said pocket having reduced pressure because of said sealing strip blocking the penetration of air into the pocket and generating a partial vacuum condition in said pocket;

a variable spacing being defined between the sealing strip and the support belt that is passing over the first drying cylinder, said spacing being variable due to the sealing strip support itself being shiftable transversely to a central cylinder plane;

the first and second cylinders having respective rotation axes that define said central plane between the rotation axes of the drying cylinders, the guide roll being at one side of the central plane, the pocket being defined between the drying cylinders and the guide roll and being defined at the side of the central plane toward the guide roll;

a porous support belt for passing from the first drying cylinder, then over the guide roll, and then over the second drying cylinder; the drying cylinders, the guide roll and the porous support belt being so placed with respect to each other and being so arranged with respect to a web to be dried that such web is present between the outer surfaces of the first and second cylinders and the support belt, and such that the support belt is present between the guide roll outer surface and the web;

wherein the guide roll has a perforated roll shell and includes a hollow roll journal at an end thereof, said journal opens toward the inside of the guide roll, and the hollow roll journal being connectable with a vacuum source;

a first edge chamber at a first end region of the guide roll, and means for generating a higher vacuum in the first edge chamber than in the rest of the interior of the guide roll; the first edge camber has an inner region toward the axially inner end thereof which is toward the remainder of the guide roll, and in the inner region of the first edge chamber, a partition supported in the pocket by the sealing strip support and the partition having an external shape which is adapted generally to the outer surfaces of the drying cylinders;

during rotation of the drying cylinders and of the guide roll, the partition being so shaped and oriented as to be in an intermediate plane which is perpendicular to the axis of rotation of the guide roll.

20. The arrangement of claim 19, further comprising a rotatable shaft for supporting the partition, the shaft extending in the intermediate plane between the drying cylinders and the rotary shaft is turnable by about 90° to turn the partition into a pocket central plane lying between the two drying cylinders.

21. The arrangement of claim 20, further comprising bearings at the sealing strip support on which the rotatable shaft is rotatable with respect to the sealing strip support.

22. The arrangement of claim 20, further comprising a lift device for lifting the sealing strip support a distance away from the pocket and for returning the support toward the pocket.

23. The arrangement of claim 22, further comprising a locking device for locking the sealing strip support against being raised by the lift device when the partition lies in the intermediate plane.

24. An arrangement for a single-wire drying group for a web of paper, or the like, to be dried, the drying group comprising:

a first drying cylinder having an outer surface and located upstream in the path of travel of a flexible porous support belt, a second drying cylinder having an outer surface and located downstream of the first drying cylinder in the path of travel of the support belt, and a guide roll having an outer surface and disposed between the first and second cylinders along the path of travel of the support belt, such that the support belt travels from the first drying cylinder to the guide roll and then to the second drying cylinder;

the first and second drying cylinders and the guide roll being so placed with respect to each other that they together define a pocket between the first and second cylinders;

a sealing strip in the vicinity of the outer surface of the first drying cylinder, means supporting the sealing strip at a location for blocking the penetration of air into the pocket along with the entrance into the pocket of the support belt;

said pocket having reduced pressure because of said sealing strip blocking the penetration of air into the pocket and generating a partial vacuum condition in said pocket;

a lift device for lifting the sealing strip supported a distance away from the pocket and for returning the support toward the pocket;

a variable spacing being defined between the sealing strip and the support belt that is passing over the first drying cylinder, said spacing being variable due to the sealing strip support itself being shiftable transversely to a central cylinder plane;

the first and second cylinders having respective rotation axes that define said central plane between the rotation axes of the drying cylinders, the guide roll being at one side of the central plane, the pocket being defined between the drying cylinders and the guide roll and being defined at the side of the central plane toward the guide roll;

a porous support belt for passing from the first drying cylinder, then over the guide roll, and then over the second drying cylinder; the drying cylinders, the guide roll and the porous support belt being so placed with respect to each other and being so arranged with respect to a web to be dried that such web is present between the outer surfaces of the first and second cylinders and the support belt, and such that the support belt is present between the guide roll outer surface and the web.

25. An arrangement for a single-wire drying group for a web of paper, or the like, to be dried, the drying group comprising:

a first drying cylinder having an outer surface and located upstream in the path of travel of a flexible porous support belt, a second drying cylinder having an outer surface and located downstream of the first drying cylinder in the path of travel of the support belt, and a guide roll having an outer surface and disposed between the first and second cylinders along the path of travel of the support belt, such that the support belt travels from the first drying cylinder to the guide roll and then to the second drying cylinder;

the first and second drying cylinders and the guide roll being so placed with respect to each other that they together define a pocket between the first and second cylinders;

a sealing strip in the vicinity of the outer surface of the first drying cylinder, means supporting the sealing strip at a location for blocking the penetration of air into the pocket along with the entrance into the pocket of the support belt;

said pocket having reduced pressure because of said sealing strip blocking the penetration of air into the pocket and generating a partial vacuum condition in said pocket; p1 a variable spacing being defined between the sealing strip and the support belt that is passing over the first drying cylinder, said spacing being variable due to the sealing strip support itself being shiftable transversely to a central cylinder plane;

the first and second cylinders having respective rotation axes that define said central plane between the rotation axes of the drying cylinders, the guide roll being at one side of the central plane, the pocket being defined between the drying cylinders and the guide roll and being defined at the side of the central plane toward the guide roll;

a porous support belt for passing from the first drying cylinder, then over the guide roll, and then over the second drying cylinder; the drying cylinders, the guide roll and the porous support belt being so placed with respect to each other and being so arranged with respect to a web to be dried that such web is present between the outer surfaces of the first and second cylinders and the support belt, and such that the support belt is present between the guide roll outer surface and the web;

an end wall at each end of the guide roll and at each axial end of the pocket for closing the axial ends of the pocket and the end walls being generally adapted to the cross-sectional shape of the pocket.

26. The arrangement of claim 25, further comparison a swing drive operable for swinging at least one end wall outward from the end of the pocket.

27. The arrangement of claim 26, further comprising a lift device for lifting the sealing strip support a distance away from the pocket and for returning the support toward the pocket;

means coupling the swing drive to the lift device of the sealing strip support so that the lift device raises the sealing strip support when the swing drive raises the end wall of the pocket.

* * * * *